US011814202B2

(12) United States Patent
Sas Freixenet et al.

(10) Patent No.: US 11,814,202 B2
(45) Date of Patent: Nov. 14, 2023

(54) MACHINE FOR FILLING BAGS WITH A GRANULAR PRODUCT AND CORRESPONDING FILLING METHOD

(71) Applicant: TÉCNICAS MECÁNICAS ILERDENSES, S.L., Lleida (ES)

(72) Inventors: Josep Sas Freixenet, Lleida (ES); Juan José González Toledano, Lleida (ES)

(73) Assignee: TECNICAS MECANICAS ILERDENSES, S.L., Lleida (ES)

( * ) Notice: Subject to any disclaimer, the term of this patent is extended or adjusted under 35 U.S.C. 154(b) by 174 days.

(21) Appl. No.: 17/600,433

(22) PCT Filed: May 6, 2019

(86) PCT No.: PCT/ES2019/070294

§ 371 (c)(1),
(2) Date: Sep. 30, 2021

(87) PCT Pub. No.: WO2020/225458

PCT Pub. Date: Nov. 12, 2020

(65) Prior Publication Data

US 2022/0219850 A1 Jul. 14, 2022

(51) Int. Cl.

| | |
|---|---|
| ***B65B 39/06*** | (2006.01) |
| ***B65B 51/22*** | (2006.01) |
| ***B65B 51/14*** | (2006.01) |
| ***B65B 51/32*** | (2006.01) |
| ***B65B 1/22*** | (2006.01) |

(52) U.S. Cl.

CPC ..... *B65B 39/06* (2013.01); *B65B 1/22* (2013.01); *B65B 51/146* (2013.01); *B65B 51/225* (2013.01); *B65B 51/32* (2013.01)

(58) Field of Classification Search

None

See application file for complete search history.

(56) References Cited

FOREIGN PATENT DOCUMENTS

| | | | | |
|---|---|---|---|---|
| DE | 10232136 A1 * | 1/2004 | ..... | B65B 1/28 |
| DE | 10232136 A1 | 1/2004 | | |
| ES | 2388510 A1 * | 10/2012 | ..... | B65B 43/465 |
| ES | 2388510 A1 | 10/2012 | | |

(Continued)

OTHER PUBLICATIONS

International Search Report from corresponding International Application No. PCT/ES2019/070294 dated Jan. 31, 2020.

*Primary Examiner* — Tanzim Imam

(74) *Attorney, Agent, or Firm* — TUCKER ELLIS LLP

(57) ABSTRACT

The present invention relates to a machine for filling bags with a granular product comprising a filling station, a welding station, and a cooling station. The machine comprises a supporting device for supporting the bags below the stations. The device comprises a supporting surface assembled in a pivoting manner on a pivot shaft, and actuating means. The supporting surface has a first supporting segment for supporting the bags of the filling and welding stations on one side of the pivot shaft and a second segment for supporting the bag of the cooling station on the opposite side of said pivot shaft. The supporting surface can pivot in an alternating manner around said pivot shaft for moving the base of the bag which, in operation, is located in the filling station during filling. The invention also relates to a filling method.

7 Claims, 4 Drawing Sheets

(56) References Cited

FOREIGN PATENT DOCUMENTS

| | | | | | |
|---|---|---|---|---|---|
| FR | 2614270 | A1 * | 10/1988 | ..... | B65B 1/22 |
| FR | 2614270 | A1 | 10/1988 | | |
| JP | 2009091023 | A | 4/2009 | | |
| WO | 2014191152 | A1 | 12/2014 | | |

* cited by examiner

MACHINE FOR FILLING BAGS WITH A GRANULAR PRODUCT AND CORRESPONDING FILLING METHOD

RELATED APPLICATION DATA

This application is a national phase application of International Application No. PCT/ES2019/070294 filed May 6, 2019. The entirety of the aforementioned application is incorporated herein by reference.

FIELD OF THE INVENTION

The invention relates to machine for filling bags with a granular product comprising a filling station, a welding station, and a cooling station.

Furthermore, the invention also relates to a method for filling bags with a granular product comprising a filling step, a welding step, and a cooling step for the corresponding bags.

STATE OF THE ART

In the industry of filling bags with granular products, a higher bag filling speed is constantly sought to reduce production costs.

In the invention, granular product is understood to mean a product the grain size of which is greater than 50 microns. Moreover, in the invention, a high production or high speed machine is understood to mean an hourly production exceeding 1800 bags/hour.

Nevertheless, the high bag filling speed is not without its issues. An important limitation that arises by increasing the bag filling speed lies in the proper arrangement of the bag during filling. In other words, by increasing the bag filling speed, it may easily occur that the bottom of the bag wrinkles. This represents an important issue in the final bag filling quality. A bag with a bottom that is wrinkled during filling is then filled in a non-uniform manner, such that once it is full it readily deforms and adopts irregular shapes. This effect complicates palletizing the bag.

To avoid this issue, it is known to raise the opening of the bag during the filling operation in the filling station. Nevertheless, this method is not without its drawbacks. First, raising the bag during filling involves moving a considerable mass, increasing the power consumption of the machine. Another added issue is that by raising the bag, due to the inertia caused by the mass, the maximum speed that the station can reach is limited.

Another known alternative consists of the filling station being stationary. In exchange, there is provided below the filling station a supporting surface for supporting the base of the bag during filling. This supporting surface can move up and down in the vertical direction. While filling the bag, it is shaken with its contents as a result of moving the bottom up and down. This solution consumes considerable power. Moreover, the upper part of the bag readily deforms, and therefore it is not filled optimally from a geometric viewpoint. This again complicates palletization.

Document ES 2388510 A1 discloses a solution to facilitate filling the bag in a uniform manner. This document provides that in the filling station, the conveyor belt on which the bag is supported during filling is assembled to pivot in an alternating manner around a rotating shaft. Once the filling process has ended, i.e., the bag is full, the conveyor belt taps the base of the bag to improve filling and impart uniformity to the shape of the bag. In this case, the final shape of the bag is more regular and palletizing full bags is facilitated, but it does not allow filling bags at high production speeds.

SUMMARY OF THE INVENTION

The purpose of the invention is to provide a machine for filling bags with a granular product of the type indicated above, which allows filling up the bags at high filling speeds. Nevertheless, and despite the high speed, the machine must have a lower power consumption and obtain full closed bags that can be readily palletized.

This is achieved by means of a machine for filling a bag with a granular product and closing it of the type indicated above, characterized in that further comprises a supporting device for supporting the bags which forms a unit arranged below said filling, welding, and cooling stations for supporting, during operation, the base of each of the bags that are located in each of said filling, welding, and cooling stations, and said supporting device comprising a supporting surface, a pivot shaft, and actuating means, said supporting surface being assembled on said pivot shaft such that said supporting surface has a first supporting segment arranged facing said welding and filling stations on one side of said pivot shaft, and a second supporting segment facing said cooling station on the opposite side of said pivot shaft, and in that said supporting surface, said pivot shaft, and said actuating means are functionally associated with one another such that said supporting surface can pivot in an alternating manner around said pivot shaft through said actuating means between an upper position of said first segment and a lower position of said second segment, and a lower position of said first segment and an upper position of said second segment, for moving the base of the bag which, in operation, is located in said filling station during filling.

The machine according to the invention has a number of advantages. First, the pivoting supporting surface for supporting the base of the bags which are in a substantially vertical position during filling is balanced. The full bags from the welding station and cooling station balance the movement of the supporting surface tapping the base of the bag that is being filled. As a result, power consumption of the assembly is reduced. Furthermore, this allows a very rapid pivoting, which facilitates being able to increase the filling speed without the bottom of the bag creasing. Moreover, pivoting takes place during the filling operation for the bag which is located in the filling station. Cycle speed is thereby reduced without losing the capacity of obtaining a bag shape that can be readily palletized.

The invention further includes a number of preferred features that are object of the dependent claims and the utility of which will be highlighted hereinafter in the detailed description of an embodiment of the invention.

In a preferred embodiment, at the end of said first segment opposite the end of the pivot shaft, said supporting device has a transverse projection which is transverse to the forward movement direction of the bags which projects from said first segment and is located upstream away from said filling station in the forward movement direction of the bags, such that in operation, with said bag being ready to be filled, before the filling of said bag begins, said projection holds the base of said bag away from said filling station.

As a result of this element, when the bag is placed at the mouthpiece of the filling station and before the filling thereof begins, its base is supported or held at this projection. This causes the bag to form an angle with respect to the vertical direction. Therefore, a bag which is still empty is not in the substantially vertical position, slightly supported on the supporting surface. This thereby prevents the effect, in some cases, of preliminary wrinkles being formed at the bottom of the bag. Once the filling begins, these wrinkles hinder obtaining a bag with a regular shape or geometry. This irregular geometry results in a more complicated palletization of the bag.

In an embodiment which seeks to improve orientation of the bags when conveyed from station to station, said supporting device is a conveyor belt. The bags are transferred from station to station secured by the opening, but as a result of the lower conveyor belt they are prevented from being able to tip over due to an imprecise support position of the base.

In another embodiment, said cooling station and said welding device are at the same distance from said pivot shaft. This optimizes the balancing of the supporting device when the bag pending being filled is empty.

In another embodiment which seeks to improve and accelerate the sealing of the bag, in the cooling station there are provided gas actuating means arranged for insufflating cooling gas at the weld spots of the bag for accelerating the cooling process.

The invention also relates to a method for filling bags with a granular product which is characterized in that during said filling, welding, and cooling steps, each of the bags which is located in each of said steps is supported at the base of said bags on a supporting device for supporting the bags which forms a unit and is assembled in a pivoting manner around a pivot shaft, said pivot shaft being located between said welding step and said cooling step, such that said surface has a first supporting segment arranged facing said welding and filling stations on one side of said pivot shaft, and a second supporting segment facing said cooling station on the opposite side of said pivot shaft, and in that said method further comprises a tapping step in which said supporting surface can pivot in an alternating manner around said pivot shaft through said actuating means, between an upper position of said first segment and a lower position of said second segment, and a lower position of said first segment and an upper position of said second segment, for moving the base of the bag which is located in said filling station during the filling step for filling said bag.

In a preferred embodiment, the method further comprises a holding step for holding the base of the bag in which, before the filling of said bag begins, the base of said bag is held away from said filling step, upstream of said filling step, in the forward movement direction of the bags.

Likewise, the invention also includes other features of detail illustrated in the detailed description of an embodiment of the invention and in the accompanying figures.

BRIEF DESCRIPTION OF THE DRAWINGS

Further advantages and features of the invention will become apparent from the following description, in which, without any limiting character, preferred embodiments of the invention are disclosed, with reference to the accompanying drawings in which.

DETAILED DESCRIPTION OF EMBODIMENTS OF THE INVENTION

Figure 1:
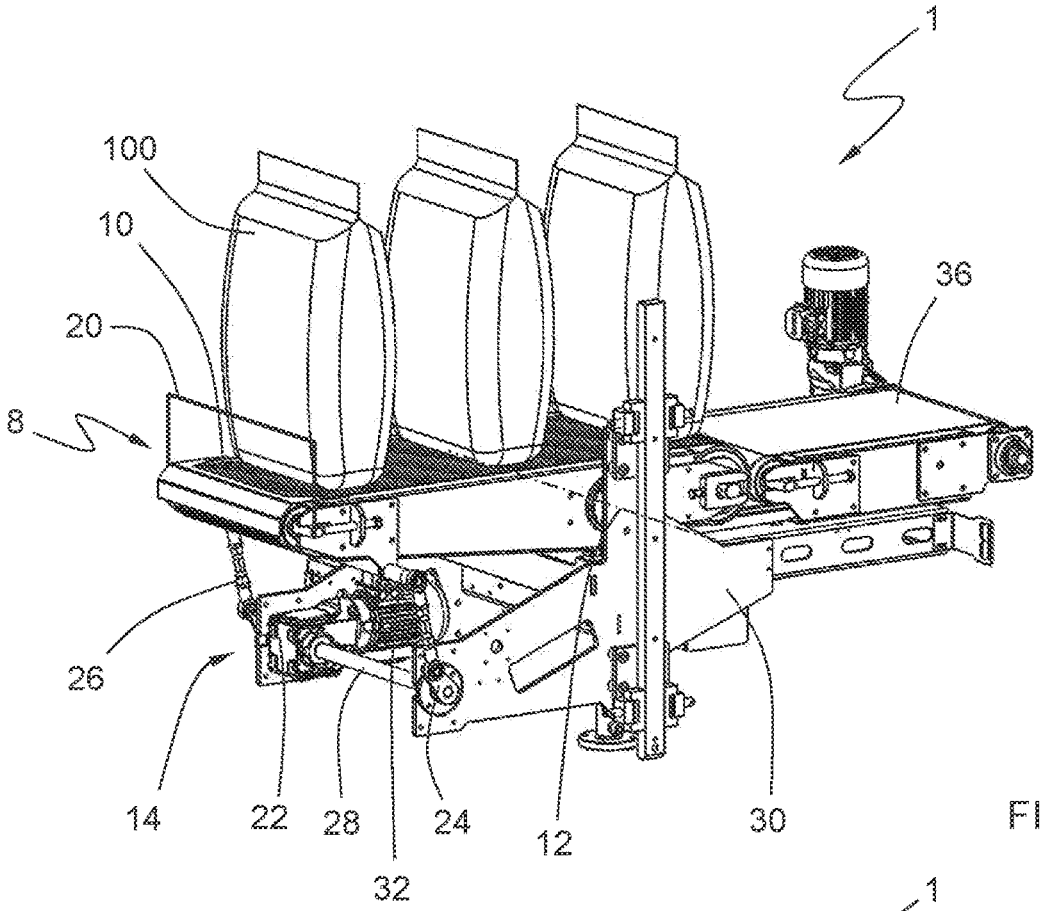
FIG. 1 shows a schematic perspective view of the machine for filling bags with a granular product according to the invention in which the supporting surface for supporting the bags is located with the first segment of the supporting surface in an upper position.

The drawings show an embodiment of a machine 1 for filling bags 100 with a granular product according to the invention.

In the upper part, the machine 1 comprises a filling station 2, a welding station 4, and a cooling station 6. These stations are only schematically shown in the drawings.

Some known non-limiting examples of machines having these filling, welding, and cooling stations are bag filling machines using pre-formed bags or machines in which the bags are manufactured in the machine itself from a film material, known in the art by its acronym FFS, i.e., Form, Fill, and Seal. This would be the example of the view shown in FIG. 3, in which the bag feeding station 40 can be seen in the lower part. As a result, it is not considered necessary to describe its components in detail since the features of these stations are known to one skilled in the art.

As discussed, the issue with bag filling machines that has still not been satisfactorily solved in the art consists of providing a machine for filling bags at high filling speeds, but said machine must have, despite the high speed, a lower power consumption and in said machine the full closed bags must have a uniform shape, and accordingly be such that they can be easily palletized.

To solve this problem, the machine 1 according to the invention has a supporting device 8 for supporting the bags 100 which forms a common unit. In the embodiment, this supporting device 8 is a conveyor belt. Nevertheless, other solutions, such as a stationary supporting surface, or other solutions which facilitate the transition of the bags 100 between each of the stations of the machine, such as a polished surface, rollers, or other mechanisms, for example, can be conceived.

The supporting device 8 for supporting the bags 100 is arranged below the filling, welding, and cooling stations 2, 4, 6. Therefore during normal operation of the machine 1, the base of each of the bags 100 that are located in each of said filling, welding, and cooling stations 2, 4, 6 can be supported on the supporting device 8.

The supporting device 8 comprises as its main elements an upper supporting surface 10, a pivot shaft 12, and actuating means 14 for actuating the supporting surface.

It can be seen in the drawings that the supporting surface 10 is assembled such that it can rotate around the pivot shaft 12 in a manner known to one skilled in the art. The supporting surface 10 has a first supporting segment 16 on one side of the pivot shaft 12, whereas the supporting surface has a second supporting segment 18 on the opposite side.

The first segment 16 is arranged facing the welding and filling stations 2, 4. The second supporting segment 18 is facing the cooling station 6 and is on the opposite side of said pivot shaft 12. As can be seen in the drawings, as a result of this, the base of the bags 100 of the filling and welding stations is supported on the first segment 16, whereas the base of the bag of the cooling station 6 is supported on the second segment 18.

Figure 3:
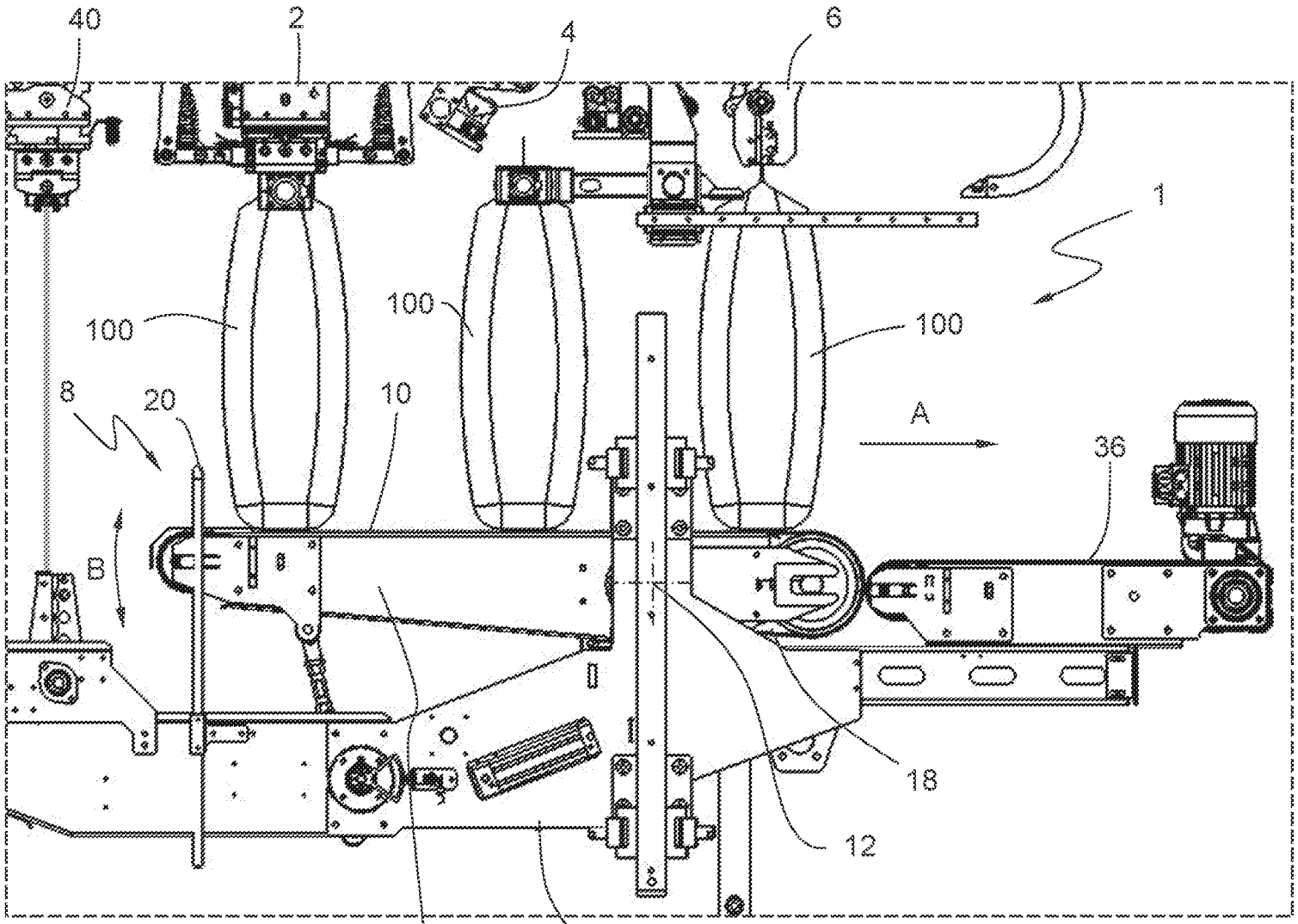
FIG. 3 shows a front schematic view of the machine for filling bags with a granular product according to the invention.
Figure 4:
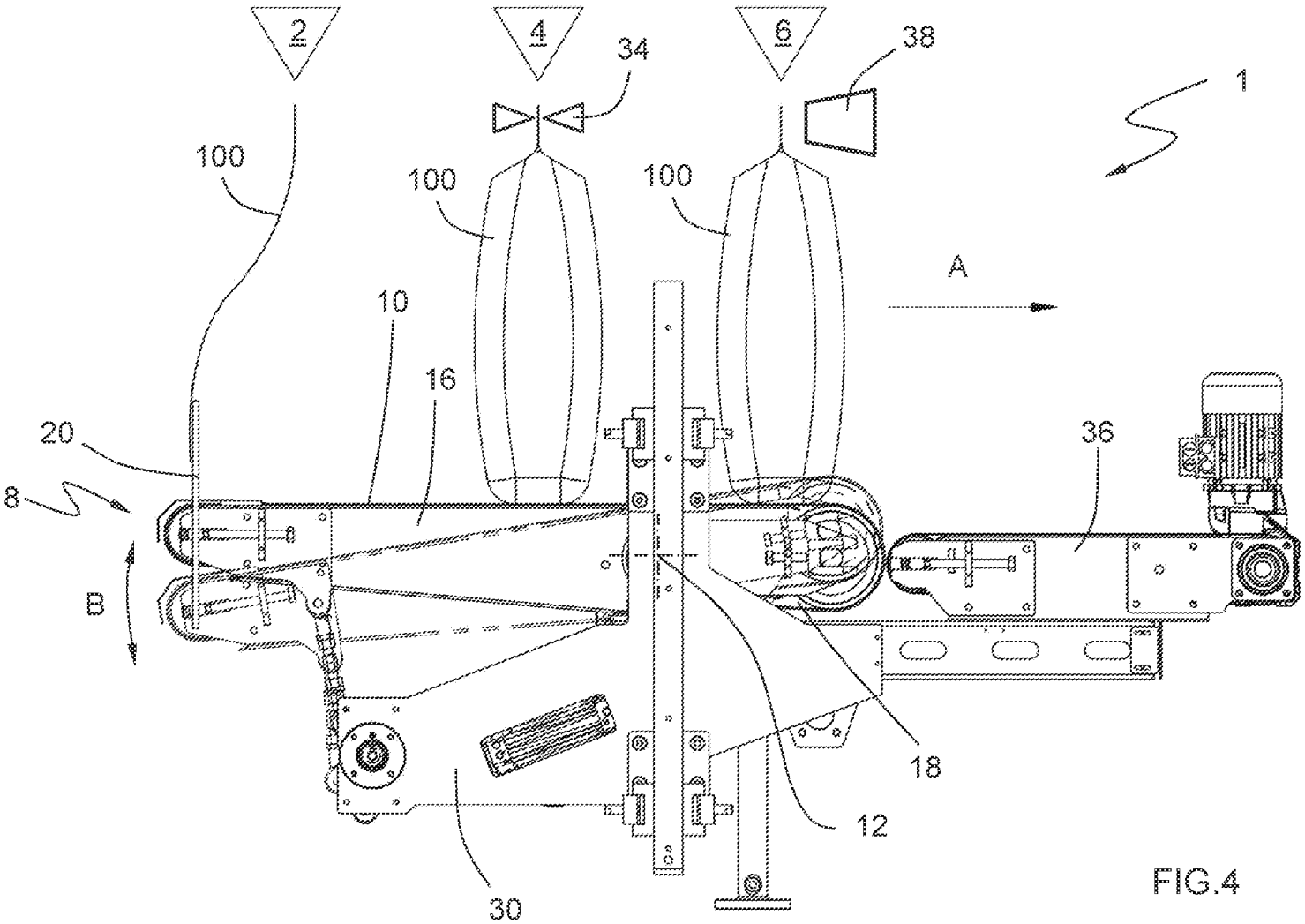
FIG. 4 shows a front schematic view of the machine for filling bags with a granular product according to the invention in the moment before the filling step for filling the bag in the filling station begins.

It can be seen in FIGS. 3 and 4 that to obtain a better balancing in the machine, the cooling station 6 and the welding device 34 are at the same distance from the pivot shaft 12. This leads to the bags of the welding station 4 and cooling station 6 balance one another out. In a particularly preferred manner, the welding device 34 consists of a welding device by heat sealing or by ultrasonic sealing. Also in a preferred manner, gas actuating means 38 can be provided in the cooling station to reduce the cooling cycle for cooling the weld of the corresponding bag 100.

The actuating means 14 are formed by a geared motor 22 actuating a second shaft 28. The second shaft 28 is assembled such that it can rotate on a stationary frame 30 of the supporting device 8. An articulated connecting rod 24 and crank 26 mechanism is assembled at each of the ends of the secondary shaft. Each of the cranks 26 is assembled articulated on a third shaft 32 mounted on the side walls of the conveyor belt.

Figure 2:
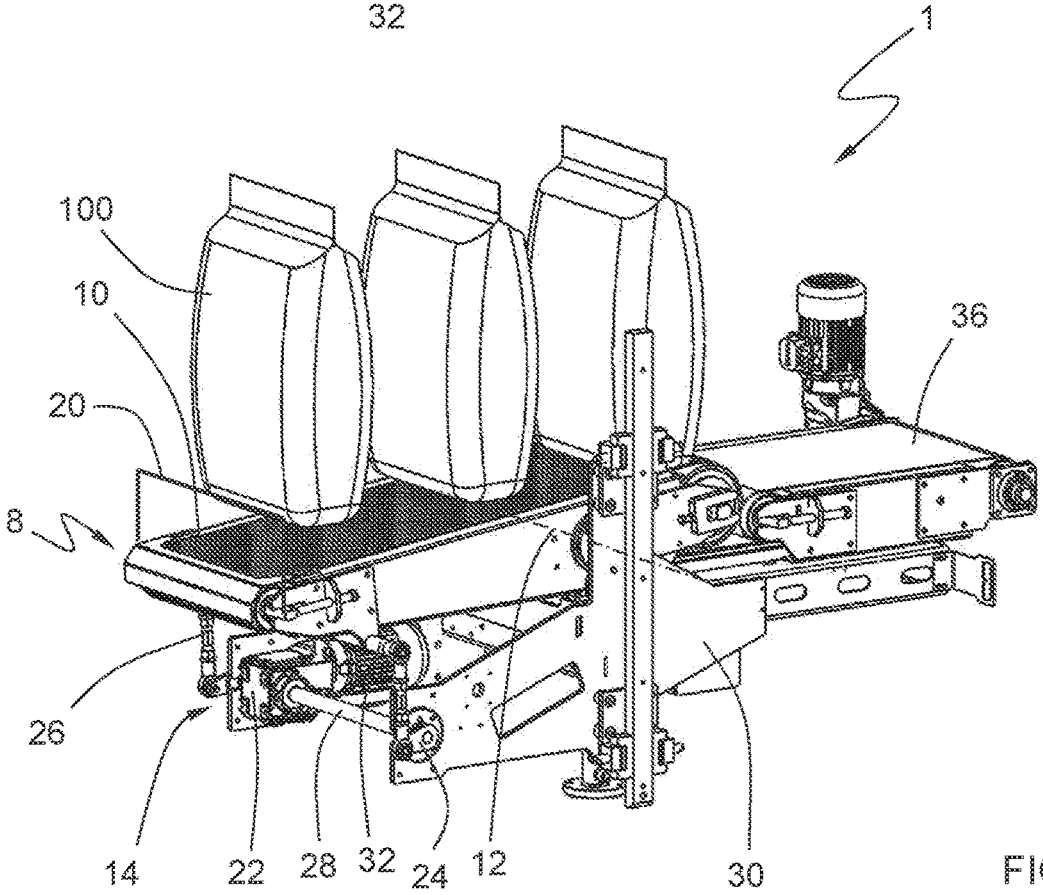
FIG. 2 shows a schematic perspective view of the machine of FIG. 1 in which the supporting surface for supporting the bags is located with the first segment of the supporting surface in a lower position.
Figure 5:
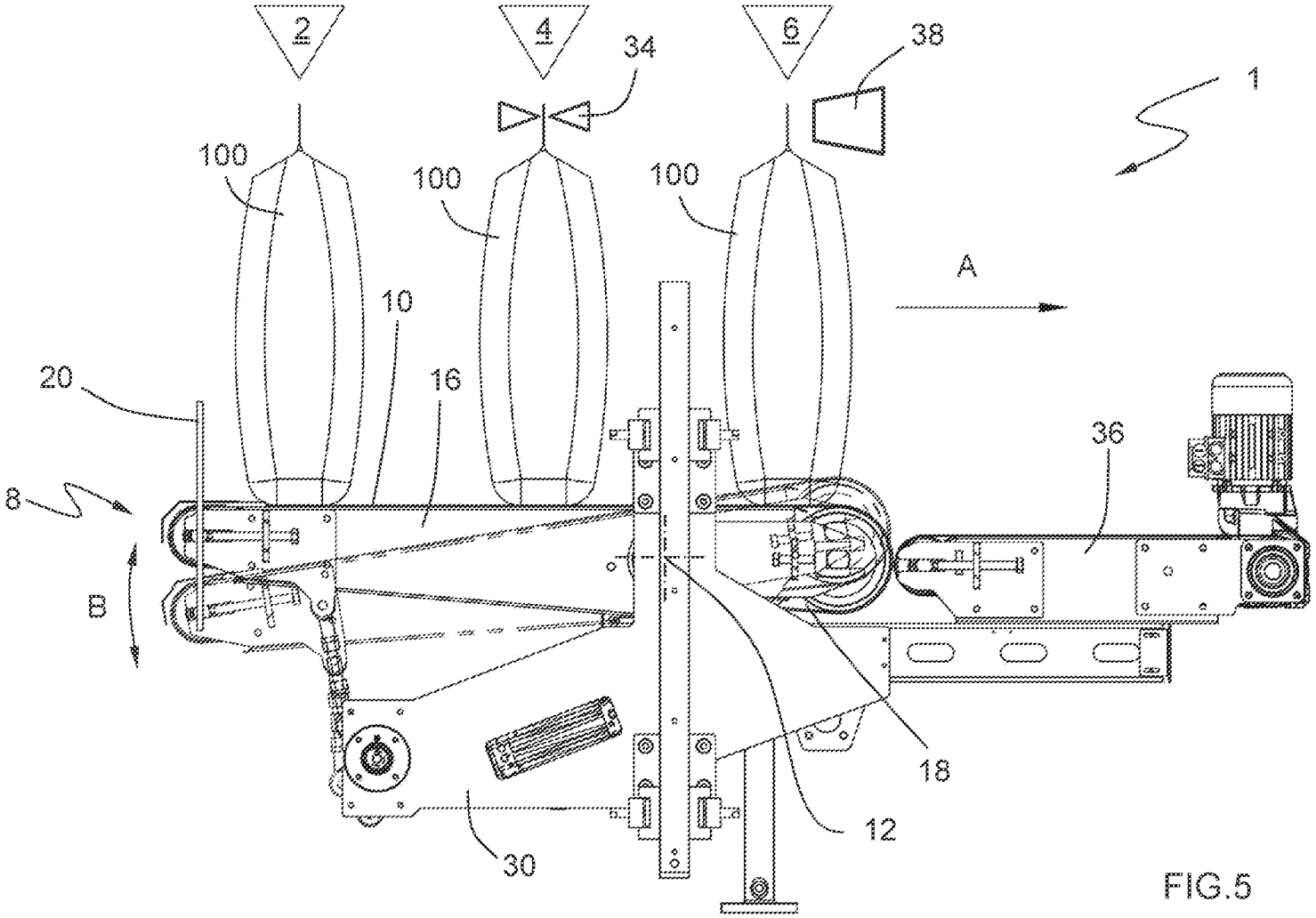
FIG. 5 shows a front schematic view of the machine for filling bags with a granular product according to the invention with the bag of the filling station once it is filled.

In this manner, the pivot shaft 12 and the actuating means 14 are functionally associated with one another. Therefore, the supporting surface 10 can pivot in an alternating manner around the pivot shaft 12 through the actuating means 14 between an upper position of said first segment 16 and a lower position of said second segment 18, and a lower position of the first segment 16 and an upper position of said second segment 18. This pivoting movement during the filling step is indicated with the double-headed arrow B of FIGS. 3 to 5. Moreover, the upper position of the first segment 16 can be seen in a particularly clear manner in FIG. 1 or 3, whereas the lower position corresponds to FIG. 2. FIGS. 4 and 5 show both positions overlapping.

As a result of these elements, the supporting surface 10 can pivot in an alternating manner for moving the base of the bag 100 which, in operation, is located in the filling station 2 during filling. These positions are depicted through the end positions of FIG. 4 or 5. This pivoting movement has several synergistic effects. First, it helps to compact the granular product and filling is improved. Furthermore, as it pivots during the filling step and as the granular product is compacted as it falls into the bag, filling is also faster. This effect also reduces cycle time compared with the known systems in the state of the art. Finally, filling is also more homogeneous, and therefore the geometry of full bag is also more regular. This facilitates palletizing.

Optionally and to reduce the eventual risk of wrinkles forming at the base of the bag, it is provided in the machine 1 that at the end of the first segment 16 opposite the end of the pivot shaft 12 in the supporting device 8, there is assembled a transverse projection 20 which is transverse to the forward movement direction of the bags 100. This projection 20 projects from the first segment 16 and is located upstream away from the filling station 2 in the forward movement direction of the bags 100, i.e., before the filling station 2. This arrangement can be seen clearly in FIG. 4.

When the machine 1 is in operation, the base of the bag 100 ready to be filled, particularly before the filling of said bag 100 begins, is held at the transverse projection away from said filling station 2. This arrangement can be observed in FIG. 4. This prevents the base of the bag 100 from being directly supported on the supporting surface 10 when the bag is still empty and forming wrinkles. Therefore, when filling of the bag 100 begins, after a certain bag filling level, the weight of the granular product causes the base of the bag to surpass the transverse projection 20. The bag 100 then pivots and is placed on the supporting surface 10. Nevertheless, there is now no risk of forming wrinkles which may hinder a homogeneous filling of the bag.

The method for filling bags 100 with a granular product according to the invention is explained below.

The method comprises a filling step, a welding step, and a cooling step for the bags 100 which are consecutive and simultaneous. In other words, during normal operating conditions of the machine 1, while a bag 100 is filled in the filling station, another bag 100 is closed in the welding station, and finally, the bag 100 that entered first is in standby in the cooling station to assure proper closing of the bag.

During operation, each of the bags 100 which is located in each of the mentioned steps is supported at the base on the supporting device 8 for supporting the bags 100 which forms a unit, i.e., it is a one-piece unit. As discussed above, the supporting device 8 is assembled in a pivoting manner around the pivot shaft 12.

The pivot shaft 12 is located on a plane between the welding step and the cooling step. Therefore, the supporting surface 10 has a first supporting segment 16 arranged facing the welding and filling stations on one side of said pivot shaft 12. In turn, the supporting surface 10 has a second supporting segment 18 facing the cooling station 6 on the opposite side of the pivot shaft 12.

The method further comprises a tapping step in which the supporting surface 10 can pivot in an alternating manner around the pivot shaft 12 through the actuating means 14, between the upper position of the first segment 16 and a lower position of said second segment 18 described above, and a lower position of the first segment 16 and an upper position of said second segment 18. The base of the bag 100 which is located in the filling station 2 during the filling step for filling said bag 100, i.e., during the period in which the granular product is falling into the bag 100, can thereby be moved.

The method further comprises a holding step for holding the base of the bag 100 in which, before the filling of the bag 100 begins, the base of the bag 100 is held away from the filling step, upstream of the filling step, in the forward movement direction of the bags 100 to prevent unnecessary wrinkles before filling of the bag begins.

Moreover, once the bag 100 of the filling station is full and the bag 100 of the welding station 4 is closed, and in the bag 100 of the cooling station the weld has been sufficiently cooled, the three bags 100 are shifted in the forward movement direction of arrow A in FIGS. 4 and 5 through the pivoting arms shown only partially on the left side of FIG. 3. Therefore, the bag 100 which is located in the cooling station is delivered to second stationary conveyor belt 36 which delivers the closed bag 100.

The machine 1 and method according to the invention allow obtaining production speeds greater than those that are common in the state of the art, but with an identical or lower consumption than those of the state of the art.

The invention claimed is:

1. A machine for filling bags with a granular product, the machine comprising a filling station, a welding station, and a cooling station, wherein the machine further comprises:

[a] a supporting device for supporting the bags, which forms a unit arranged below said filling, welding, and cooling stations for supporting, during operation, a base of each of the bags that are located in each of said filling, welding, and cooling stations, said supporting device comprising:

[b] a supporting surface,

[c] a pivot shaft, and

[d] actuating means,

[e] said supporting surface being assembled on said pivot shaft such that said supporting surface has a first supporting segment facing said welding and filling stations on one side of said pivot shaft, and a second supporting segment facing said cooling station on an opposite side of said pivot shaft, and wherein

[f] said supporting surface, said pivot shaft, and said actuating means are functionally associated with one another such that said supporting surface can pivot in an alternating manner around said pivot shaft through said actuating means between

[i] an upper position of said first supporting segment and a lower position of said second supporting segment, and

[ii] a lower position of said first supporting segment and an upper position of said second supporting segment, for moving a base of a bag which, in operation, is located in said filling station during filling.

2. The machine according to claim 1, wherein at an end of said first supporting segment opposite to the pivot shaft, said supporting device has a transverse projection which is transverse to a forward movement direction of the bags and which projects from said first supporting segment and is located upstream away from said filling station in the forward movement direction of the bags, such that in operation, before the filling of a bag begins, said projection holds a base of a base of bag away from said filling station.

3. The machine according to claim 1, wherein said supporting device is a conveyor belt.

4. The machine according to claim 1, wherein said cooling station and said welding station are at the same distance from said pivot shaft.

5. The machine according to claim 1, wherein in the cooling station there is provided gas actuating means arranged for insufflating cooling gas at weld spots of a bag that is located in the cooling station.

6. A method for filling bags with a granular product comprising a filling step performed at a filling station, a welding step performed at a welding station, and a cooling step performed at a cooling station for the bags, wherein during said filling, welding, and cooling steps,

[a] each of the bags is supported at its base on a supporting device for supporting the bags which is assembled in a pivoting manner around a pivot shaft,

[b] said pivot shaft being located between said welding station and said cooling station, such that a supporting surface of the supporting device has a first supporting segment arranged facing said welding and filling stations on one side of said pivot shaft, and a second supporting segment facing said cooling station on an opposite side of said pivot shaft, and wherein

[c] said method further comprises a tapping step in which said supporting surface pivots in an alternating manner around said pivot shaft through an actuating means, between

[i] an upper position of said first supporting segment and a lower position of said second supporting segment, and

[ii] a lower position of said first supporting segment and an upper position of said second supporting segment, for moving a base of a bag which is located in said filling station during the filling step for filling said bag.

7. The method according to claim 6, wherein the method further comprises a holding step for holding the base of the bag, in which, before the filling of said bag begins, the base of said bag is held away from said filling station and upstream of said filling station, in a forward movement direction of the bags.

* * * * *